US005253504A

United States Patent [19]

Siegert et al.

[11] Patent Number: 5,253,504

[45] Date of Patent: Oct. 19, 1993

[54] APPARATUS FOR THE SIMULATIVE OPTIMALIZATION OF THE SUPPORTING OF A SHEET METAL BLANK ON THE SUPPORT FRAME OF A DEEP-DRAWING TOOL

[75] Inventors: Klaus Siegert, Sindelfingen; Stefan Kienzle, Leinfelden-Echterdingen, both of Fed. Rep. of Germany

[73] Assignee: Mercedes-Benz AG, Fed. Rep. of Germany

[21] Appl. No.: 967,708

[22] Filed: Oct. 28, 1992

[30] Foreign Application Priority Data

Nov. 14, 1991 [DE] Fed. Rep. of Germany ..... 4137453

[51] Int. Cl.[5] ..... B21D 22/22

[52] U.S. Cl. ..... 72/350

[58] Field of Search ..... 72/296, 297, 350, 347

[56] References Cited

U.S. PATENT DOCUMENTS

| | | | |
|---|---|---|---|
| 2,378,413 | 6/1945 | Lermont et al. | 72/297 |
| 3,302,437 | 2/1967 | Dolney | 72/296 |
| 3,452,574 | 7/1969 | Mackenzie | 72/297 |

*Primary Examiner*—Lowell A. Larson

*Attorney, Agent, or Firm*—Evenson, McKeown, Edwards & Lenahan

[57] ABSTRACT

An apparatus for the simulative optimalization of the supporting of a sheet metal blank on the support frame of a deep-drawing tool includes a plurality of stands that are freely translatable and rotatable about a vertical axis on a horizontally aligned base plate. The stands are capable of being fixed on the base plate in any desired position in respect of translation and rotation. Each stand carries a mouth-like clamp which by means of appropriate lockable mountings can be turned and fastened about two horizontal pivot axes at right angels to one another, and which by means of a fastenable vertical guide can be adjusted and fastened in this vertical position on the stand. Each clamp contains on its bottom face a support part-surface by means of which a partial region of a support surface for the sheet blank can be simulated, and on its top face contains a clamp jaw translatable transversely thereto. With a sheet holder simulation apparatus of this kind the support frame for the sheet blank in a deep-drawing tool can be rapidly and inexpensively optimized.

11 Claims, 2 Drawing Sheets

APPARATUS FOR THE SIMULATIVE OPTIMALIZATION OF THE SUPPORTING OF A SHEET METAL BLANK ON THE SUPPORT FRAME OF A DEEP-DRAWING TOOL

BACKGROUND AND SUMMARY OF THE INVENTION

This invention relates to an apparatus for the simulative optimalization of the supporting of a sheet metal blank on the support frame of a deep-drawing tool.

The drawing of vehicle body parts in deep-drawing presses can be subdivided into four phases, namely:

1) insertion of the blank;
2) closing of the blank holder and application of the hold-down force;
3) lowering of the punch and the actual drawing operation; and
4) opening of the tool and removal of the drawn part.

Apart from the actual drawing operation, which has been very often discussed in the literature, the other two preceding phases also affect the quality of the drawn part. In good deep-drawing tools, the bottom drawing frame and the hold-down device fitting it with a matching shape must be so designed that the blank, after it has been placed on the bottom drawing frame, can be pressed by the hold-down device against the support surface of the bottom drawing frame over the full area without forming wrinkles. In connection with this, it should be borne in mind that the support surface of the drawing frame is usually by no means flat, but already approximates the three-dimensional contour of the finished drawn part. The blank clamped between the drawing frame and the hold-down device should, in addition, be spatially twisted into a shape such that the point of first contact of the descending drawing punch with the blank should lie approximately in the middle of the blank.

The prior art attempts to obtain a utilizable shape of the support surface of the drawing frame, or of the hold-down device, with development tools made of a sufficiently loadable but easily workable modeling material, such as, for example, plaster, synthetic resin or combinations of wood and plastics. This involves a tedious and cost-intensive iteration process using the "trial and error" approach. An additional difficulty is that the blank clamped in position at the edge in this manner is completely out of sight, and that any wrinkling can be seen only after the development tool has been opened. By drawing conclusions from the shape and position of the wrinkles, and on the basis of long experience, the drawing frame and the hold-down device must then be modified and a new edge clamping arrangement tested.

The development tool corresponds in each case to a specific drawn part on the scale of 1:1 and, after completion of the development of the drawing frame or hold-down device specific to the drawn part concerned, is used in its actual size for making the drawing tool suitable for production. Since for the production of a vehicle body many different drawing tools have to be developed and made available, a large amount of time is taken up solely for the development of the numerous different drawing frames before production can start.

The problem underlying the invention is that of making available a means for enabling such drawing frames or hold-down devices specific to drawn parts to be developed with optimum shapes in a shorter time and at lower cost than hitherto.

According to the invention, this problem is solved by the apparatus for the simulative optimalization of the supporting of a sheet metal blank on the support frame of a deep-drawing tool, comprising a flat, horizontally aligned base plate, which in both length and breadth is larger than the largest sheet metal blank to be studied; a plurality of stands freely translatable and rotatable about a vertical axis and capable of being fixed on the base plate in any desired position in respect of translation and rotation; wherein each stand carries a mouth-like clamp which by means of appropriate mountings can be turned and fastened about two horizontal pivot axes at right angles to one another, and which by means of a fastenable vertical guide can be vertically adjusted and fastened on the stand; and further, wherein each clamp contains on the bottom inside face of the mouth opening a support part-surface which forms a partial region of a support surface to be simulated for the sheet blank, and, lying opposite the support part-surface in the mouth opening, a clamp jaw translatable in parallel transversely to the support part-surface and capable of being pressed with a defined force against the support part-surface.

With the aid of a plurality of clamps adjustably fastened on stable stands, the drawing frame and the hold-down device can be simulated area by area and varied in a simple, rapid manner. In addition, the blank clamped at its edge is always within sight, so that the formation of wrinkles when the edges are clamped can be viewed directly. The shape of the edge clamping can even be varied while the blank is clamped in position, so that the action of variations of the shape of the edge clamping on any wrinkles formed can likewise be viewed directly. The optimum shape of the edge clamping can thus also be quickly found without trial pressings.

In order to be able to check whether the drawing punch actually makes its first contact with the clamped blank in the middle, it is sufficient to lower a part of the drawing punch, or a hand specimen of the finished component, in a defined position. The situation of the first point of contact can be seen visually by side viewing and can also be determined by making reference marks.

Other objects, advantages and novel features of the present invention will become apparent from the following detailed description of the invention when considered in conjunction with the accompanying drawings.

DETAILED DESCRIPTION OF THE DRAWINGS

Figure 1:
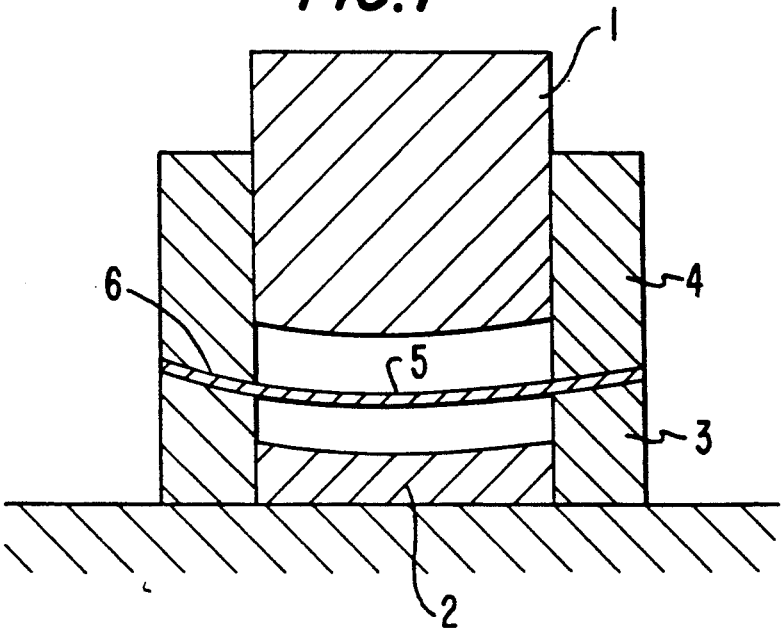
FIG. 1 is a schematic cross-section through a deep-drawing tool with its drawing frame and hold-down device.

The schematic representation of a deep-drawing tool in FIG. 1 shows a bottom drawing frame 3, with a support surface 6 on which a blank 5 lies at its edge. The blank 5 is clamped in place by the hold-down device 4 which is pressed downwards with a defined force. The hold-down device 4 has, of course, a shape negative to that of the support surface 6. The drawing punch 1 is disposed inside the hold-down device 4, and the counterpressure tool 2 is disposed inside the drawing frame and under the blank 5. Other configurations of deep-drawing tools in accordance with the basic construction of the respective drawing press are of course also possible. In any case, however, a drawing frame and a hold-down device, which clamp the edge of the blank with a defined force, are disposed on the outside of the deep-drawing tool. For a perfect drawing result or a faultless deep-drawn part, it is quite essential that the support surface 6 of the drawing frame have a shape which is specific to the drawn part and which must be found empirically.

Figure 2:
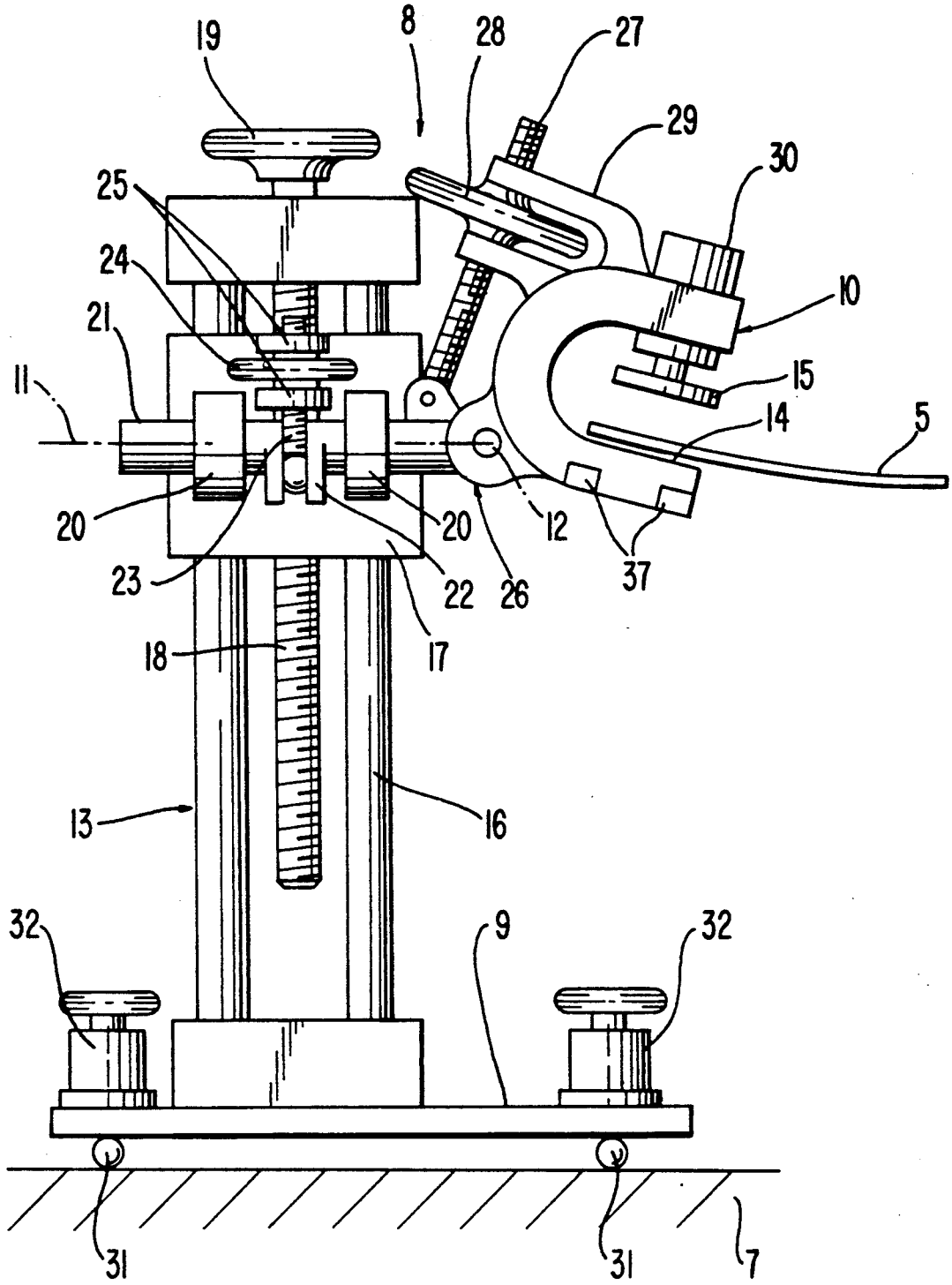
FIG. 2 is a side view of a stand for a clamp.

The present invention described below with respect to FIG. 2 serves this purpose. With the present invention's aid, the function of the drawing frame 3 and of the hold-down device 4 can be simulated and also quickly varied. For this purpose, a plurality of stands 8 are provided. The stands 8 movably fasten a clamp 10 and can be freely translated and rotated on a base plate 7, on which the stands 8 can be fastened in any position. In both length and width, the base plate 7 is larger than the largest sheet metal blank 5 to be studied. In addition, the base plate 7 is aligned horizontally and has the smoothest and flattest possible surface. If T-slots are formed in the base plate 7 for fastening the stand 8 by means of its foot 9, these slots are expediently closed flush with the surface by means of filler strips at the places where they are not required, so that a continuous surface is formed. Instead of T-slots it is also possible to provide numerous threaded holes, distributed in a grid pattern in the base plate, in order to enable the foot plates of the stands to be fastened on it.

Since the stands 8 are very stable and accordingly heavy, they are provided with caster wheels 31 to facilitate their movement. The caster wheels are adjustable in height with the aid of an adjusting drive 32 and are completely retractable into the foot 9 of the stand 8. When the caster wheels 31 have been retracted, the foot plate 9, of the stand 8, lies directly on the base plate 7 and the stand 8 is frictionally fastened on the baseplate 7 by its dead weight alone. In order to increase the fastening force, the foot plate 9, as already stated, can be fastened on the base plate 7 with the aid of T-slots formed in the latter. Instead of retractable caster wheels 31, the stand 8 can also be fixed in the translatory and rotational positions found on the base plate 7 by means of lockable caster wheels. This facility may also be provided as a means of provisionally fastening the stand in addition to the lower ability of the caster wheels.

Each stand 8 carries a mouth-like clamp 10 which is movably secured on the stand with three degrees of freedom of movement. The clamp 10 can, in fact, be vertically adjusted and fastened along a vertical guide 13. In addition, the clamp 10 can be turned about two horizontal pivot axes 11 and 12 at right angles to one another, and can be fastened in position.

In the exemplary embodiment illustrated, the vertical guide 13 is in the form of a column guide comprising two vertical guide columns 16 in parallel alignment and a carriage 17 guided thereon. The vertically guided carriage 17 of the stand is sensitively adjustable and automatically fastenable by means of a handwheel 19 and a fine-threaded spindle 18. A nut screw thread matching the fine-threaded spindle 18 is provided in the carriage 17. The fine-threaded spindle 18 is mounted for rotation in the crosshead disposed at the top on the guide columns 16, while being incapable of axial movement. The handwheel 19 is mounted at the projecting end of the fine-threaded spindle 18.

The first of the two pivot mountings of the clamp 10 consists of a pair of horizontal guide bushes 20 disposed on the carriage 17 and a guide pin 21 extending rearwards from the clamp 10. The guide pin 21 can be turned about the first axis 11 inside the guide bushes 20. For this purpose, in the exemplary embodiment illustrated, a pair of lever arms 22 is mounted on the guide pin 21 in the region between the two guide bushes 20. A fine-threaded spindle 23 acts on the outer end of the lever arms 22 with the aid of a pivot joint. A handwheel support 25 composed of a pair of brackets disposed one above the other is provided above the two lever arms 22 on the carriage 17. The fine-threaded spindle 23 extends through the pair of brackets 25. A handwheel 24 is mounted between the pair of brackets 25 for wobbling movement of the handwheel 24 while keeping it incapable of axial movement. The handwheel 24 is provided centrally with a nut screw thread which can be screwed on the fine-threaded spindle 23. The guide pin 21 can be sensitively pivoted by turning the handwheel 24. Because of the self-locking of the fine screw thread and of a certain stiffness of the handsheet 24 axial mounting, the swivel mounting of the guide pin is automatically fixed in each new position.

At the end of the guide pin 21 which faces the clamp 10, a unidimensionally turnable pivot joint 26 is provided. The clamp 10 is pivoted on the guide pin 21 by means of the pivot joint 26. In the normal position of the guide pin 21 and pivot joint 26, which is shown in FIG. 2, the second pivot axis 12 formed by the pivot joint 26 is aligned horizontally. In all cases, however, the second pivot axis 12 is at right angles to the first pivot axis 11. A spindle drive is also provided for turning the clamp 10 in relation to the guide pin 21 by means of the pivot joint 26. Another fine-threaded spindle 27 is pivoted on the guide pin 21 and the pivot eye and the spindle axis being at a distance from the second pivot axis 12.

In the exemplary embodiment illustrated, the clamp 10 carries a forked handwheel support 29, through which the fine-threaded spindle 27 extends. A handwheel 28 is likewise mounted, between the forks of the handwheel support, for wobbling movement while being axially immovable. Here again, the handwheel 28 is provided centrally with a nut screw thread which can be screwed on the fine-threaded spindle 27. With the aid of this spindle drive, the clamp 10 can be sensitively turned about the second pivot axis 12 and, because of the self-locking of the screw drive, can be automatically locked in the new position found.

The mouth-like clamp 10 contains on its bottom inside face of the mouth opening a support part-surface 14, which forms a part-region of a support surface to be simulated for the sheet metal blank 5. Opposite the support part-surface 14 in the mouth opening, a clamp jaw 15 is disposed. The clamp jaw 15 is movable parallel to itself and is guided transversely to the support part-surface 14. The clamp jaw 15 can be pressed against the support part-surface 14 with a defined force. For this purpose the top part of the mouth-like clamp 10 contains a hydraulic piston 30 by whose piston rod the clamp jaw 15 can not only be guided but also pressed into contact with a defined force. The clamp jaw 15 is mounted for wobbling movement on the outer end of the piston rod and during the closing movement of the clamp jaw can readily adapt to the position of the edge of the blank. By simultaneously applying a high fluid pressure in the hydraulic piston 30 in all the clamps participating in the simulation, a clamping force corresponding to operating conditions can be simulated. At the same time, it can be checked whether or not the sheet metal blank clamped at various points of its edge is wrinkled. The mouth-like clamps 10 and the appertaining hydraulic pistons 30 must be of sufficiently sturdy construction to enable even high, realistic clamping forces of the order of up to about 120 kN per clamp to be applied using the clamps.

Figure 3:
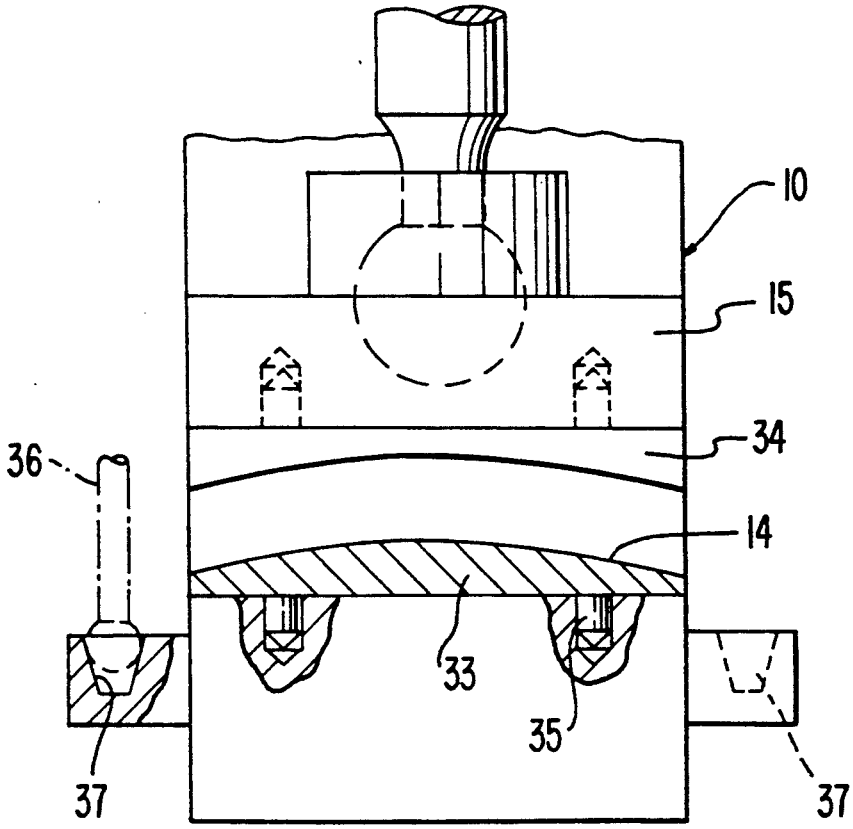
FIG. 3 shows on a large scale a detail of the clamp shown in FIG. 2.

In order to be able to use the clamp 10 for simulating not only flat but also curved support part-surfaces 14, the latter are formed on an exchangeable shaped part 33 which can be inserted in a defined position into the bottom part of the clamp as shown in FIG. 3. By means of fastening pins 35, the shaped part 33 is secured in a defined position in a holding surface in the clamp. Similarly, a shaped part 34, which can be fitted in a defined position, is also provided on the facing clamp jaw 15. The shaped part has a surface shaped negatively to the surface shape of the support part-surface 14. With exchangeable sets of shaped parts 33 and 34 of this kind, all shapes of support part-surfaces which are possible in practice can be formed and varied during the simulation.

When after various trials, which can be carried out quickly and without great expense, a utilizable simulated "shape" of the support surface 6 has been found with the various clamps 10, the relative positions of the clamps to one another are determined with the aid of a multicoordinate measuring apparatus, which is installed in the region between the stands which was previously occupied by the blank 5. The sheet metal blank 5 must therefore be removed from the clamps on the stands, and replaced by a multicoordinate measuring apparatus disposed between the stands. A multicoordinate measuring apparatus of this kind is expediently of the single-column type having a horizontally projecting measuring arm. Instead, however, it is also possible to provide a multicoordinate measuring apparatus of the portal type which, after the style of a crane bridge, extends above the base plate 7 and the stands erected thereon, and in which a measuring sleeve is guided for movement up and down on a travelling bridge and carries at its bottom end a measuring feeler pin 36. The aim of the measurement of the positions of the clamps is not to determine the absolute positions of the individual clamps in space, but only to determine their relative positions to one another.

In order to be able to detect the found position of the claims with the aid of a multicoordinate measuring apparatus, each clamp 10 is provided with at least three feeler contact surfaces 37 which are spaced apart from one another and lie, not on a uniform straight line, but at the corner points of a preferably right-angled triangle or of a polygon. In cases where the feeler contact surfaces representing respective individual points are disposed at the corner points of a right-angled triangle, it is expedient for the sides of the triangle to be parallel or at right angles to the end face of the clamps and for the plane of the triangle to lie parallel to the support part-surface. The feeler contact surfaces in the exemplary embodiment illustrated are in the form of recessed cones, into which the sensor ball of a measuring feeler pin 36 can penetrate, so that the feeler contact surface 37 can be unmistakably sensed. Detection of the spatial positions of at least three such feeler contact surfaces 37 enables the spatial position of the clamp 10 to be unmistakably determined. Although such detection is possible only through the expedient of determining the absolute positions of the individual feeler contact surfaces 37 relative to a zero point of the multi-coordinate measuring apparatus, once all the feeler contact surfaces 37 of all the clamps have been detected, the position of the reference system plays no further part in the measurement, but the relative positions of the individual points or individual clamps to one another can then be directly read and represented graphically on a graphic output device. This data can be sued for designing a working drawing frame 3 or a corresponding hold-down device 4.

It is true that it would be conceivable to use a swing-open design for the clamps 10, in order to facilitate the insertion into them and removal from them of a sheet metal blank 5, but for reasons of greater stability for a predetermined lowest possible weight it is more expedient to give the clamps an inherently stiff and immovable configuration. A blank is then inserted into or removed from a ring of clamps by moving the stands and clamps a certain distance aside on one side of the ring and, after insertion of the blank into the remaining clamps, pushing them back into a position previously indicated by color markings on the base plate 7. First trials with this method have shown that the previous positions of the stands can be reproduced with adequate accuracy.

In order to be able to check to what extent the edge clamping of the blank simulated in accordance with the invention and the spatially twisted shape of the blank produced thereby agree with the shape of the blank which is assumed in a deep-drawing tool, the clamps were adjusted in accordance with the drawing frame of a deep-drawn part already in series production, and the blank of the series production part, in the state in which it is merely clamped at the edge and the punch has not yet been operation, was clamped therein. This state is fixed in the blank by the edge beads, so that the blank no longer changes after the tool is opened. By clamping a blank of this kind in the previously adjusted clamps, the series state can be reconstructed with adequate accuracy and the shape of the blank can be measured. An untreated blank for the same workpiece was thereupon clamped in the identically adjusted clamps and the blank shape then assumed was also determined by measurement. Comparison of the measurement results gave an average difference in the positions of surface points of the blanks compared, or of their spatial shapes, of a maximum of 3 to 4 millimeters, which means very good agreement.

Although the invention has been described and illustrated in detail, it is to be clearly understood that the same is by way of illustration and example, and is not to be taken by way of limitation. The spirit and scope of the present invention are to be limited only by the terms of the appended claims.

WHAT IS CLAIMED IS:

1. An apparatus for simulating an optimization of the support of a sheet metal blank on a support frame of a deep drawing tool, comprising:

a flat, horizontally aligned base plate having a length and breadth larger than said sheet metal blank being studied;

a plurality of stands freely translatable and rotatable about a vertical axis, and capable of being fixed on said base plate in any desired position in respect of translation and rotation;

a mouth like clamp, carried on each of said plurality of stands, which can be turned and fastened about two horizontal pivot axis perpendicular to one another via mounting devices, said clamp being vertically adjusted and fastened on the stand via a fastenable vertical guide device;

wherein each clamp having a mouth opening comprises:

a support part surface, forming a partial region of a support surface to be simulated for said sheet metal blank, located on a bottom inside face of the mouth opening;

a clamp jaw, arranged opposite said support part surface in the mouth opening, translatable in parallel transversely to the support part surface and capable of being pressed with a defined force against said support part surface.

2. An apparatus according to claim 1, wherein the vertical guide which can be adjusted and fixed in its vertical position on the stand is in the form of a column guide comprising two vertical guide columns in parallel alignment and a carriage guided thereon.

3. An apparatus according to claim 2, wherein one of the two horizontal pivot mountings of the clamp, which can turn about two horizontal pivot axes perpendicular to one another, is formed by at least one horizontal guide bush disposed in or on the carriage and by a guide pin extending rearwards from the clamp.

4. An apparatus according to claim 3, wherein the other of the two horizontal pivot mountings is formed by a unidimensionally turnable pivot joint disposed between the guide pin and the clamp.

5. An apparatus according to claim 3, wherein at least one of the guide pin and the pivot joint of the clamp is in each case sensitively adjustable by means of a hand wheel and by means of a pivotally supported fine-threaded spindle which, by lever means acts pivotally on the guide pin or clamp respectively and lies tangentially to the respective pivot axis and is automatically fastenable because of the self-locking of the fine-threaded spindle.

6. An apparatus according to claim 2, wherein the vertically guided carriage of the stand is sensitively adjustable by a handwheel and a fine-threaded spindle and, because of the self-locking of the fine-threaded spindle, is automatically fastenable.

7. An apparatus according to claim 1, further comprising an actuating means for pressing the clamp jaw of the clamp against the support part-surface with a defined force, said actuating means being in the form of a hydraulic piston.

8. An apparatus according to claim 1, wherein the stand freely translatable, rotatable and fastenable on the base plate is movably guided on the base plate by at least one of lockable and completely retractable caster wheels.

9. An apparatus according to claim 1, wherein the support part-surface disposed at the bottom in the mouth opening is formed on a shaped part which can be exchangeably inserted in a defined position in to the bottom part of the clamp, and in that the clamp jaw facing the support part-surface is likewise provided with an exchangeable shaped part capable of being mounted on it in a defined position and having a surface shaped negatively to the surface shape of the support part-surface.

10. An apparatus according to claim 1, wherein each clamp of the stands is provided with at least three feeler contact surfaces which are spaced apart from one another and not disposed on a straight line, each of which can be unmistakably sensed by the sensor ball of a measuring feeler pin of a multicoordinate measuring apparatus and is allocated to the support part-surface of the clamp in known relative position.

11. An apparatus according to claim 1, wherein the clamp jaw is fastened for wobbling movement.

* * * * *